US006494316B1

(12) United States Patent
Bloch et al.

(10) Patent No.: US 6,494,316 B1
(45) Date of Patent: Dec. 17, 2002

(54) ARTICLE STORAGE AND DISPLAY CONTAINER

(75) Inventors: Ilene Bloch, Akron, OH (US); Tamara Zemlansky, Cuyahoga Falls, OH (US)

(73) Assignee: Sterling Jewelers Inc., Akron, OH (US)

( * ) Notice: Subject to any disclaimer, the term of this patent is extended or adjusted under 35 U.S.C. 154(b) by 0 days.

(21) Appl. No.: 09/708,286

(22) Filed: Nov. 9, 2000

(51) Int. Cl.[7] ..... B65D 25/24
(52) U.S. Cl. ..... 206/45.2; 206/6.1; 206/566
(58) Field of Search ..... 206/6.1, 45.2, 206/45.23, 232, 566; 211/85.2

(56) References Cited

U.S. PATENT DOCUMENTS

| | | | | |
|---|---|---|---|---|
| 1,265,046 A | | 5/1918 | Burnham | |
| 1,883,012 A | * | 10/1932 | Shields | |
| 2,000,681 A | | 5/1935 | Weller | |
| 3,942,632 A | | 3/1976 | Witkoff | 206/45.2 |
| 4,043,450 A | | 8/1977 | Rielly | 206/45.14 |
| 4,310,091 A | * | 1/1982 | Hara et al. | 206/45.2 |
| 4,413,726 A | * | 11/1983 | Davidson | 206/45.23 |
| 4,424,899 A | * | 1/1984 | Rosenberg | 206/45.23 |
| 4,917,235 A | | 4/1990 | Feiler | 206/6.1 |
| 5,322,159 A | * | 6/1994 | Houlihan | 206/45.2 |
| 5,967,326 A | | 10/1999 | Tessler | 206/566 |

* cited by examiner

*Primary Examiner*—David T. Fidei
(74) *Attorney, Agent, or Firm*—Reese Taylor

(57) ABSTRACT

A storage and display container for the storage and display of small articles such as jewelry includes a base or display unit and a cover removably received on the base or display unit. The base or display unit includes first and second display areas, one for the article and one for the indicia bearing material relating to the article. The cover for removably closing off the display unit is provided with a tapered top wall so that it can be removed from the display unit, inverted and have the display unit replaced in its open end. The cover has a tapered top wall so that, when inverted, it will support the display unit at an angle to one viewing it. A modified form of the invention includes a slot in the wall of the display unit for receipt of a transport, storage and display package which carries the indicia bearing material. The package has a pocket for receipt of the article for transport and storage when the article is not being displayed.

11 Claims, 4 Drawing Sheets

ARTICLE STORAGE AND DISPLAY CONTAINER

FIELD OF THE INVENTION

This invention relates, in general, to combined storage and display containers which are convertible from one mode to another and relates, in particular, to such a convertible container for small articles wherein the cover serves as a support for the base for display purposes when not in the storage mode.

BACKGROUND OF THE INVENTION

It is known in the prior art that articles such as, for example, items of jewelry and the like are typically stored in a variety of boxes generally having covers which are either fully removable or hinged to as to be movable between open and closed positions.

These containers generally have a soft non-abrasive lining and a slot, hook, strap or some other means of mounting the article to be stored within the box as well as for display of the article. The boxes themselves are also often used for display purposes in display cases or on display counters by simply opening the box so that one can view the article.

Examples in the patent prior art are of general interest in this regard. For example, Weller U.S. Pat. No. 2,000,681 shows a jewelry display case having a cover which fits over the jewelry tray and with the cover capable of being inverted to receive and support the tray. A collapsible easel is also provided within the cover so that the tray and the article may be displayed at an angle with regard to the cover supporting surface to be more attractive and more eye catching to prospective purchasers.

Burnham U.S. Pat. No. 1,265,046 also shows the concept of inverting a cover to support a tray which forms the bottom portion of the box. Rielly U.S. Pat. No. 4,043,450 is generally similar in that a hinged cover/base combination is provided with an insert which can be placed on top of the box for display purposes. Feiler U.S. Pat. No. 4,917,235 is also generally relevant as is Witkoff U.S. Pat. No. 3,942,632. Tessler U.S. Pat. No. 5,967,326 also shows a display unit for rings or articles of jewelry.

However, as previously noted, it is desirable to be able to display the article at an angle and, except for the discrete easel structure previously mentioned, none of the prior art known to the applicant provides a convertible cover/base structure which makes this possible.

Thus, the known prior art fails to show a compact, convertible container for storage and display which utilizes the cover, per se, to provide the tilted display function and also provides internally, on the base, means for displaying informational material such as certificates of authenticity, etc. as well as the article itself. Furthermore, it is believed desirable to provide a base which is suitable for use without the cover in a larger support or tray in which a number of such container bases can be employed concurrently to display a range of articles in a compact single display unit.

SUMMARY OF THE INVENTION

It is therefore an object of this invention to provide a combined storage and display container in which the display portion or base is suitable for use with or without the cover for display purposes and which provides an area for displaying informational material as well as a display pedestal for receipt of the article itself.

It is a further object to provide a combined storage and display container of this general nature in which the cover is provided with a slanted or tapered top wall so as to make it possible for the cover to fully enclose the base including a display pedestal projecting upwardly from the base which is employed to display the actual article, when the combination is in its storage or transportation mode.

It is a further object of the invention to provide such a cover with a slanted or tapered top surface so that upon removal and inversion of the cover, the base may be positioned within the opening of the cover, thereby displaying the base and the article carried thereon at an angle with respect to a supporting surface such as a counter top or shelf for enhanced customer attraction.

A modified form of the invention provides for a slot in at least one edge of the base for the receipt of a transport, storage and display package. It has been found that this package can comprise an elongate transparent member with opposed pockets, one of which receives the indicia bearing information relating to the article to be displayed and the other of which is capable of receiving the article of jewelry itself for transport and storage. The package is fabricated of clear flexible material so that it can be folded for insertion into the slot so as to make the indicia bearing material visible to the user.

It is a still further object of the invention to provide an opaque pocket disposed on the back of the display pedestal for displaying the actual article to facilitate insertion of pricing and other information visible, not to the perspective purchaser, but to the salesperson.

Accordingly then production of an improved combined storage and display container and transport, storage and display package of the character above-described become the principal object of this invention with further objects thereof becoming more apparent upon reading of the following brief specification considered and interpreted in view of the accompanying drawings.

BRIEF DESCRIPTION OF THE PREFERRED EMBODIMENTS

Figure 1:
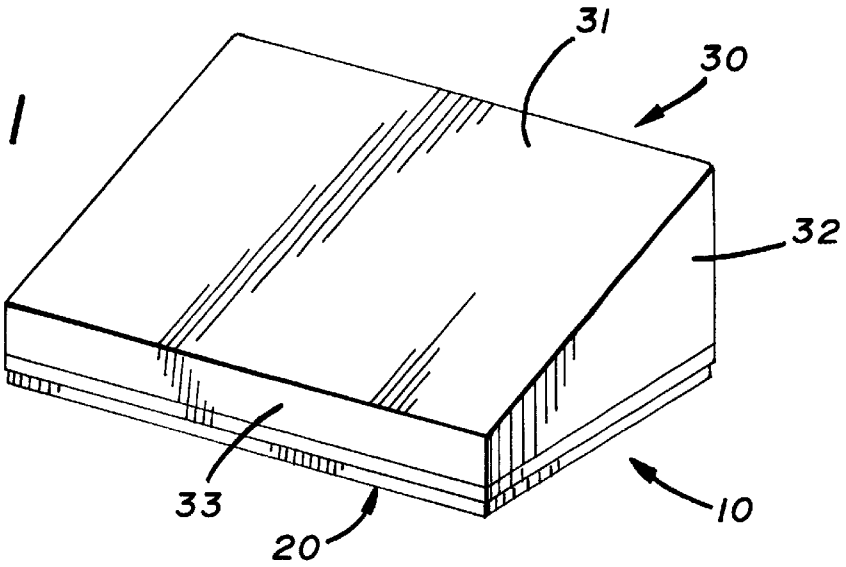
FIG. 1 is a perspective view of the improved combined storage and display container in the closed or storage condition.
Figure 2:
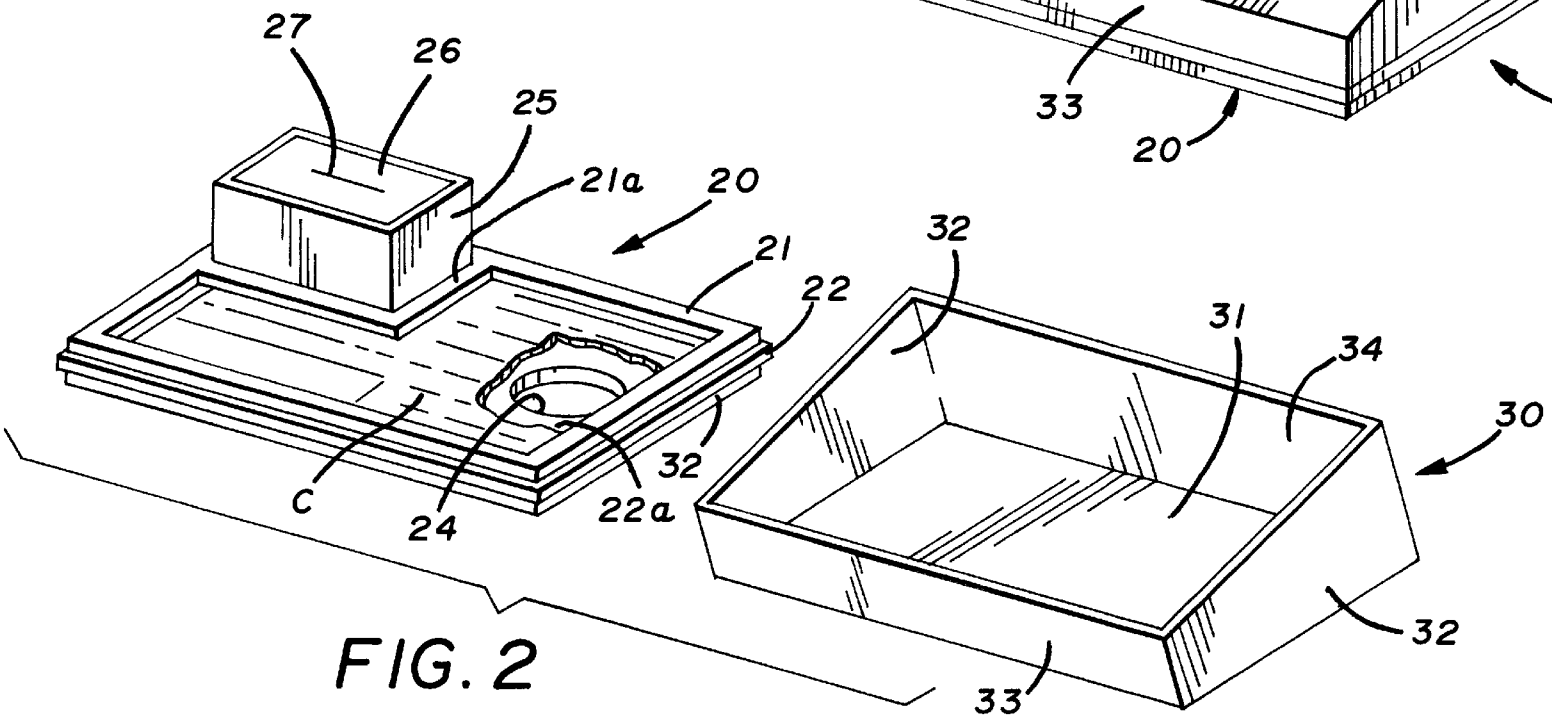
FIG. 2 is an exploded view showing the base and the cover of the improved combined storage and display container in the open position.

Referring first to FIG. 1 of the drawings, it will be seen that, in the storage mode, the improved combined storage and display container, generally indicated by the numeral 10, includes a cover 30 and a base 20. The cover 30, as can be seen in FIGS. 1 and 2 of the drawings, includes opposed side walls 32, 32 and front and rear walls 33, 34 respectively as well as a top wall 31 interconnecting the front, rear and side walls. It will be noted that the front wall 33 is considerably shorter than the rear wall 34 and that the side walls 32, 32 taper from the rear wall to the front wall so that the top wall 31 is generally tapered or slanted at an angle from the rear to the front.

Figure 4:
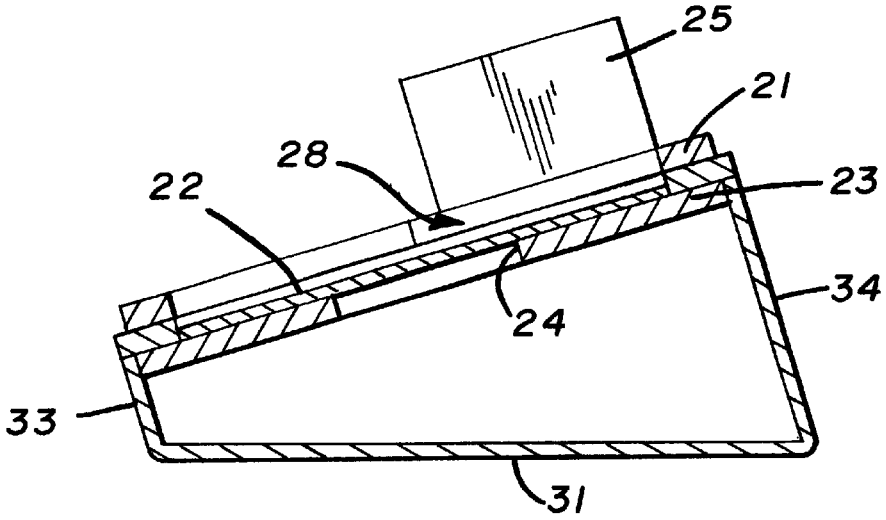
FIG. 4 is a sectional view taken along the line 4—4 of FIG. 2.

Considering FIGS. 2 and 4 then for a more detailed description of the base 20, it will be seen that, as illustrated, the base 20 is generally rectangular in planar configuration including a support shelf 22 and top and bottom peripheral walls 21 and 23 surrounding and framing the top and bottom surfaces of the support shelf 22. The support shelf member 22 is sandwiched between these and the top surface 22*a* thereof presents a substantially flat planar surface for receipt of an insert containing informational material C such as, for example, a certificate of authenticity or informational material regarding the article of jewelry or, in the case of jewelry bearing precious gems, information regarding the gem itself and perhaps certification of its authenticity. This would normally be a sheet of paper or similar material of that general nature and can be simply inserted onto the top surface of the support shelf member 22 of the base 20. An aperture 24 is provided in the support shelf member 22 so that one can easily dislodge the certificate C by inserting a finger or other object from the bottom of the base 20 to lift it off the top surface of the support shelf member 22.

Figure 3:
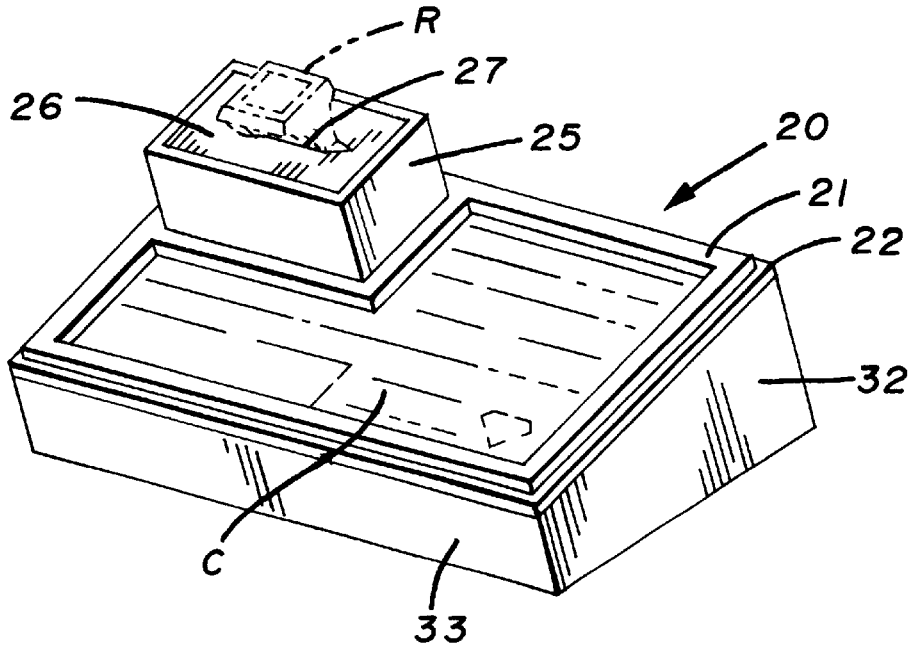
FIG. 3 is a perspective view showing the base inserted into the cover in the display mode.

The base 20 also carries a pedestal 25 which is intended to support the article of jewelry such as, for example, the ring R (see FIG. 3). This pedestal 25 projects upwardly from the base 20 and includes the usual padding or non-abrasive material, such as felt 26, with a slot 27 therein for receipt of the jewelry article. It will be understood that while a slot such as 27 is suitable for display of rings or perhaps earrings or small jewelry pieces, other means of affixing the jewelry piece to the pedestal 25 can also be employed as will be apparent to those skilled in the relevant art.

It will also be noted that the base 21*a* of the pedestal 25 is spaced from the top surface 22*a* of the support shelf 22 (see FIG. 4) so that it is possible to slide the certificate or other document C beneath it onto the top of the support shelf 22. In this fashion, the certificate or other document is readily visible but reasonably securely located and retained in place unless removed by obtaining access to it through the aperture 24.

It will also be noted that due to the tapered configuration of the cover 30, that the cover 30 easily fits over the base 20 without impinging upon the pedestal 25 or any article of jewelry stored therein so that it is not necessary to remove the same when the container is to be used in its closed or storage condition.

Still referring to FIGS. 2, 3 and 4 of the drawings, it will be seen also that top and bottom peripheral walls 21 and 23 are set back from the periphery of the support shelf 22. In the closed position of FIG. 1, of course, the edges of the walls 31, 32, and 33 rest on the top of the projecting portion of the support shelf 22 and are dimensioned so as to provide a snug fit inasmuch as the interior surfaces of the cover walls engage the top peripheral wall 21 would abut the ledge or shoulder 21.

Likewise, in the inverted condition or display mode shown in FIG. 3, the support shelf 22 will rest on the exposed edges of the walls 31, 32, and 33 and again the bottom peripheral wall 23 is recessed so that again a snug fit is provided. In both instances or modes of use, a secure yet readily releasable connection or fit is achieved.

It will be noted that, due to the tapered or angular configuration of top wall 31 of cover 30, when the top wall 31 is placed on a horizontal surface such as a counter top or shelf, and the base 20 is positioned on the cover, the base, and thus the pedestal will be disposed in a tilted or angular condition as can be seen in FIG. 4 of the drawings.

Figure 5:
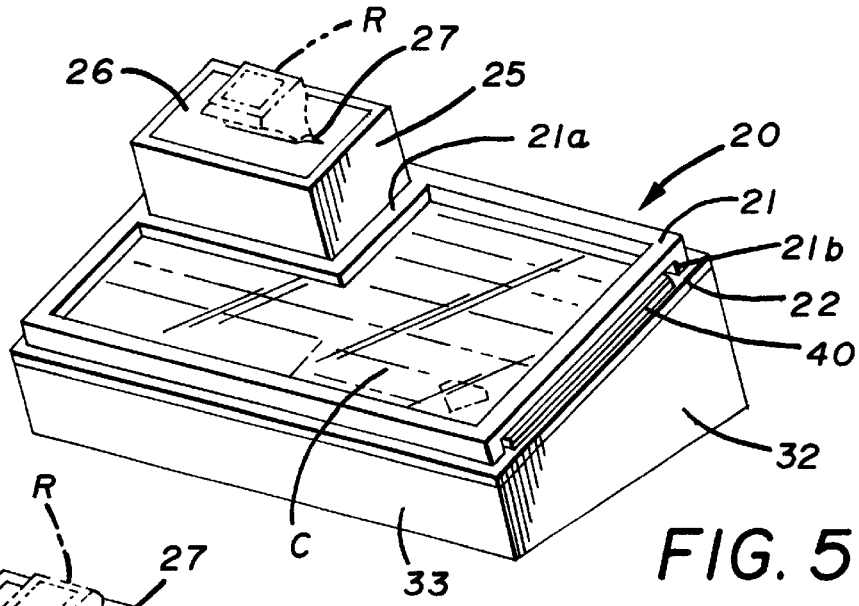
FIG. 5 is a perspective view of a further embodiment of the invention.

Referring next then to FIG. 5 of the drawings, it will be seen that a modified form of the invention embodies most of the same concepts as that shown in FIGS. 1 and 4 and described above. However, in this instance a slot 21*b* is provided in one end of the base 20 for insertion of a transport, storage and display package 40 as clearly shown in FIGS. 5 of the drawings. In this form of the invention, of course, it would be possible to eliminate the opening 24 in the bottom of the base because it is possible to remove the package 40 by grasping its end and pulling it out through the slot 21*b*.

FIG. 5 shows a further modified form of the invention in which the support 21*a* for the pedestal 25 is elongated running across the top half of the display member. This modification also facilitates the use of a smaller indicia bearing member C. It will be appreciated, of course, that the particular planar configuration of the member C is a matter of choice and the pedestal support 121*a* could just as easily be designed to take up one-half of the longitudinal length rather than running across the top or, for that matter, the bottom of the base 20.

In either event, utilization of the package 40 which will be described more fully below will be facilitated.

Figure 6:
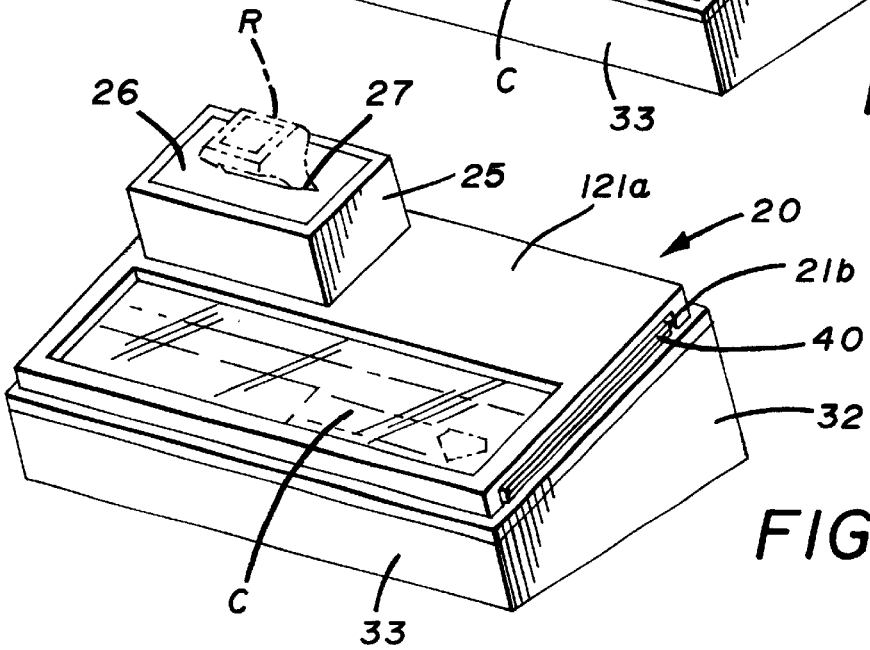
FIG. 6 is a perspective view of a still further embodiment of the invention.
Figure 8:
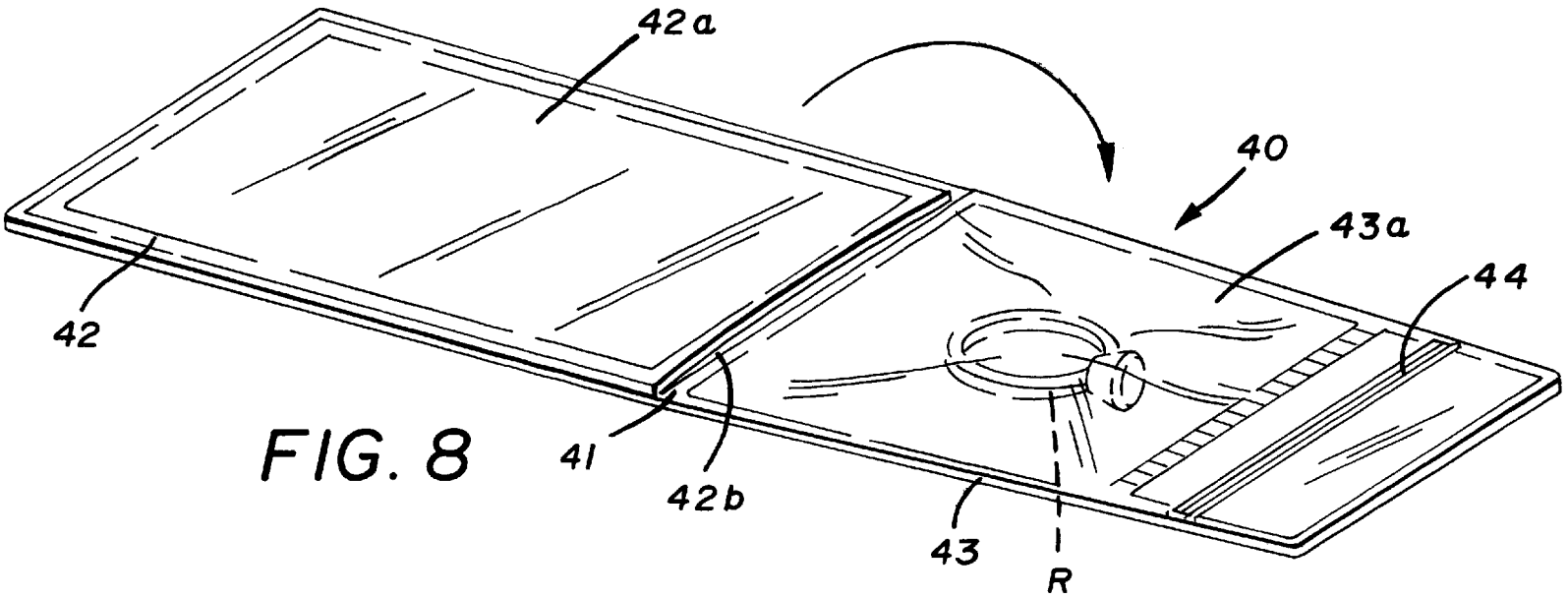
FIG. 8 is a perspective view of a transport, storage and display package for use with the embodiments of FIGS. 5, 6, and 7.
Figure 9:
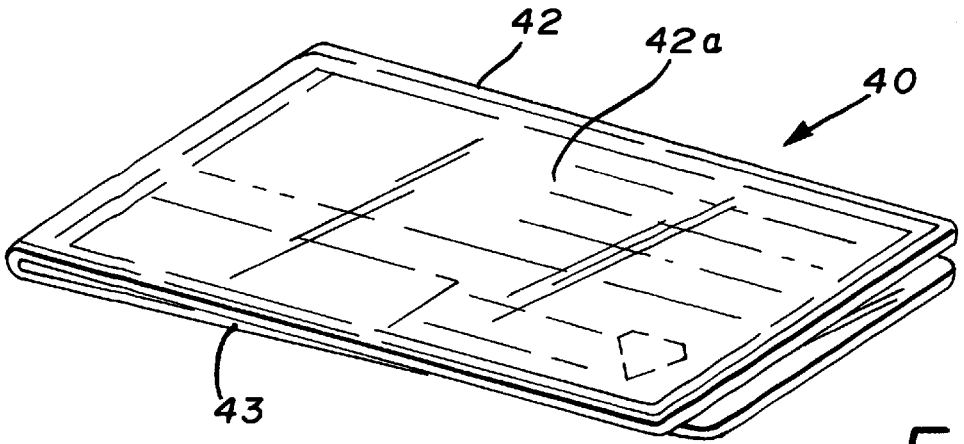
FIG. 9 is a perspective view of the package of FIG. 8 in the closed, display mode.

Turning then to FIGS. 8 and 9 of the drawings, the package 40 can be seen to be a generally elongate member fabricated of flexible, preferably opaque material and comprising two opposed pockets 42 and 43. The pocket 42 is intended to receive the certificate or other item C and has a clear top surface 42*a* so that any indicia on certificate C is readily visible. The opposed pocket 43 is intended to receive the article of jewelry R and is preferably, but not necessarily, enclosed by an opaque cover sheet 43*a*. A zip lock closure 44 adjacent the open end of pocket 42 is provided so that it is possible to store the jewelry article when it is not being used with the display unit 10. It would also be possible to ship or transport the jewelry in package 40 by itself for future use with the storage and display container. FIG. 9 illustrates the package 40 in the folded position with the certificate C clearly visible through the sheet 42*a* and in this condition it can be inserted into the display unit as illustrated in FIGS. 5 and 6 of the drawings.

Figure 7:
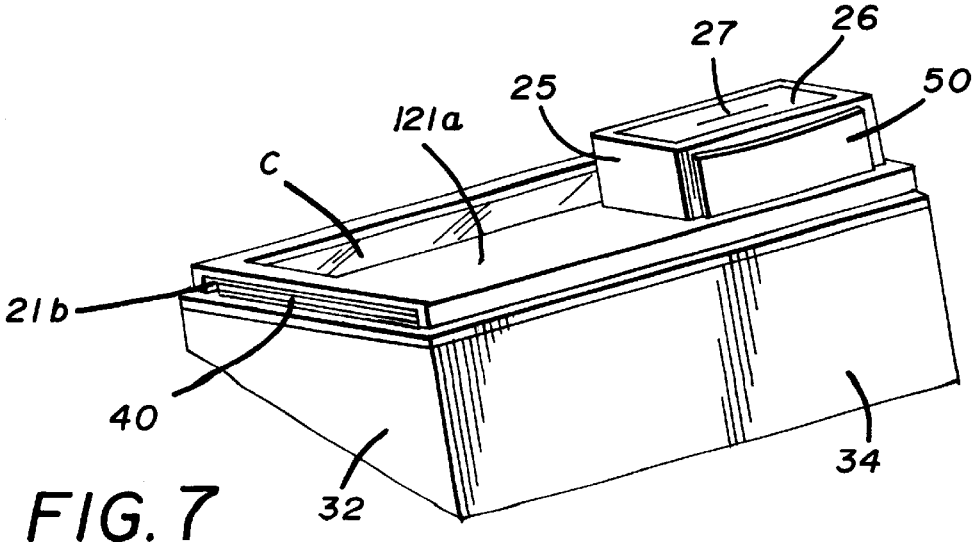
FIG. 7 is a perspective view showing yet another embodiment of the invention.

FIG. 7 shows another modification of the invention in which a clear envelope or cover is provided at the rear of the pedestal 25 as indicated by the numeral 50 to form a pocket. It is common in the sale of jewelry and other small articles for certain details, such as price, for example, regarding the article to be visible only to the salesperson, at least initially. The pocket 50 is intended to include that material and when the display unit is in use in the mode shown, for example, in FIGS. 3, 5, and 6 of the drawings, the certificate C and the article of jewelry R will be visible to the user while the other information, which is inserted removably, into the pocket 50 will be visible only to the salesperson.

It will be apparent that the modifications shown in FIGS. 5 through 9 of the drawings embody the basic concepts of the invention and all are usable with the cover 30 both in the closed and open positions.

It is accordingly apparent from the foregoing that a compact, efficient, combined storage and display container has been described and illustrated.

It will also be noted that the base 20 could be utilized by itself for display purposes. In that regard, it is conventional to provide, in display units in jewelry stores, racks or trays which are capable of displaying a number of jewelry articles such as a series of rings, etc. in the same unit. These generally are tapered and stepped and it would be simply necessary to remove the cover 30 and place one or more of the bases 20 into such a unit thereby achieving the tilted or angled display feature which is desirable.

While a full and complete description of the invention has been set forth in accordance with the dictates of the Patent Statutes, it should be understood that modifications can be resorted to without departing from the spirit hereof or the scope of the appended claims.

Thus, while the invention has been illustrated and described primarily with regard to articles of jewelry, it is believed apparent that the storage and display container could be utilized with other small articles as well.

Additionally, while the base and cover have been illustrated as generally rectangular in plan, it will be apparent that other configurations could be employed while still incorporating the inventive concept.

What is claimed is:

1. A storage and display container, comprising:

a) a display unit having first and second display areas;

b) a cover and support unit releasably receivable on said display unit in covering relationship therewith to form a closed storage compartment wherein both said first and second display areas are covered by said cover and support unit, when said cover and support unit is received to form said closed storage compartment; and c) said cover and support unit having a tapered outer surface and said display unit being removably receivable on said cover and support unit when said cover and support unit is removed and inverted.

2. The storage and display container of claim 1 wherein said first display area comprises a substantially planar surface area for receipt of informational material; and said second display area includes a pedestal projecting above at least a portion of said first display area.

3. The storage and display container of claim 2 wherein said second display area is spaced from said first display area.

4. The storage and display container of claim 1 wherein said display unit is provided with an access opening.

5. The storage and display container of claim 1 wherein said display unit comprises a substantially flat surface; a pedestal projecting above said substantially flat surface and a support ledge projecting from its periphery for support of said cover and support unit when said cover and support unit is received thereon to form said closed storage compartment; and said support ledge resting on said cover and support unit when said cover and support unit is inverted.

6. The storage and display unit of claim 2 wherein said pedestal includes a front wall and a rear wall; and a pocket for receipt of indicia bearing material is disposed on said rear wall.

7. A storage and display container, comprising:

a) a base having a top surface;

b) a pedestal carried by and projecting above said base;

c) said base having a peripheral edge and a through opening formed in said peripheral edge and opening to said top surface; and d) a cover and support unit removably received on said base and having a tapered top wall.

8. The storage and display container of claim 7 further characterized by the presence of a transport, storage and display package for receipt of said indicia bearing material and sized for slidable insertion through said through opening.

9. The storage and display container of claim 8 wherein said transport, storage and display package comprises an elongate, flexible unit having opposed pockets formed in its opposed ends.

10. The storage and display container of claim 9 wherein said transport, storage and display package is fabricated at least partially of opaque material.

11. The storage and display container of claim 7 wherein said pedestal includes a front wall and a rear wall; and a pocket for receipt of indicia bearing material is disposed on said rear wall.

* * * * *